US007144092B1

(12) United States Patent
Chang

(10) Patent No.: US 7,144,092 B1
(45) Date of Patent: Dec. 5, 2006

(54) ARRESTING APPARATUS OF MULTILAYER DRAWERS

(76) Inventor: Ting-Wei Chang, No. 354, Dama Rd., Waipu Township, Tacihung County (TW)

( * ) Notice: Subject to any disclaimer, the term of this patent is extended or adjusted under 35 U.S.C. 154(b) by 0 days.

(21) Appl. No.: 11/329,286

(22) Filed: Jan. 11, 2006

(51) Int. Cl.
*E05B 65/46* (2006.01)

(52) U.S. Cl. ..... 312/217; 312/221

(58) Field of Classification Search ..... 312/215, 312/216, 217, 220, 221, 222, 107.5; 292/DIG. 18; 70/78, 85
See application file for complete search history.

(56) References Cited

U.S. PATENT DOCUMENTS 6,347,848 B1 * 2/2002 Cho ..... 312/219
6,572,203 B1 * 6/2003 Cheng ..... 312/217
6,742,854 B1 * 6/2004 Chen ..... 312/217
6,896,342 B1 * 5/2005 Cheng ..... 312/221
2003/0141790 A1 * 7/2003 Weng ..... 312/217

* cited by examiner

*Primary Examiner*—James O. Hansen
(74) *Attorney, Agent, or Firm*—Rosenberg, Klein & Lee

(57) ABSTRACT

An arresting apparatus of multilayer drawers. Several drawers are slidably mounted in a cabinet. A linear rail is disposed on inner face of a backboard of the cabinet body. Several movable members are slidably mounted on the linear rail. The bottom section of the movable member abuts against the head section of an adjacent movable member. The bottom section of each movable member is formed with a working slope. The working slope and the linear rail define a notch. An arresting member of each drawer can be guided into the notch and located between two adjacent movable members by a locating member of the movable member.

5 Claims, 5 Drawing Sheets

ARRESTING APPARATUS OF MULTILAYER DRAWERS

BACKGROUND OF THE INVENTION

The present invention is related to an arresting apparatus of multilayer drawers for preventing the drawers from unexpectedly dropping out.

FIG. 5 shows a conventional drawer locking structure including a cabinet body 7 defining a receiving space 71 therein. The cabinet body 7 has an opening 72 on one side. Several drawers 8 are arranged in the opening 72 from upper side to lower side. A slide way assembly 731 is mounted on inner face of a back wall 73 of the receiving space 71 opposite to the opening 72. An arresting plate 9 is slidably disposed on the slide way assembly 731. The arresting plate 9 is formed with several arresting holes 91 at intervals. The arresting plate 9 is driven by an elongated rod 92 to slide. One end of the elongated rod 92 is connected with a lock 93 arranged on upper side of the opening 72. The other end of the elongated rod 92 extends to a through hole 94 of the arresting plate. A projecting section 95 of the elongated rod extends into the through hole 94. A coupling section 81 is disposed on rear side of each drawer 8. The coupling section 81 has a hook section 82 projecting toward the top of the cabinet body 7.

In operation, the lock 93 is turned to drive and rotate the elongated rod 92. The projecting section 95 of the elongated rod 92 pushes the arresting plate 9 to slide toward the hook section 82. The wall of the arresting hole 91 abuts against the coupling section 81 and the hook section 82 hooks the arresting plate 9 to lock the drawer 8. When unlocked, the lock 93 is first turned to drive the elongated rod 92. The projecting section 95 of the elongated rod 92 drives the arresting plate 9 to slide away from the hook section 82. Under such circumstance, the hook section 82 of the coupling section 81 can be moved out of the arresting hole 91 to draw the drawer 8 out from the receiving space 71.

According to the above arrangement, in the case that the cabinet body 7 is collided and tilted down, the arresting plate 9 may slide away from the hook sections 82. At this time, the drawers 8 are unlocked and may drop out of the receiving space 71.

SUMMARY OF THE INVENTION

It is therefore a primary object of the present invention to provide an arresting apparatus of multilayer drawers. Several drawers are slidably mounted in a cabinet. A linear rail is disposed on inner face of a backboard of the cabinet body. Several movable members are slidably mounted on the linear rail. The bottom section of the movable member abuts against the head section of an adjacent movable member. The bottom section of each movable member is formed with a working slope. The working slope and the linear rail define a notch. An arresting member of each drawer can be guided into the notch and located between two adjacent movable members by a locating member of the movable member. In the case that the cabinet body is collided and tilted down, the drawers will not drop out of the cabinet body.

According to the above object, the arresting apparatus of the multilayer drawers of the present invention includes:

a cabinet body having a bottom board near the ground and a top board opposite to the bottom board, the cabinet body further having several sideboards adjacent to the bottom board and the top board, one of the sideboards being formed with an opening, the cabinet body defining therein a receiving space communicating with the opening, the cabinet body having an inner wall face opposite to the opening;

several drawers slidably mounted in the receiving space, each drawer having a back board corresponding to the inner wall face, the backboard being positioned in the receiving space, an arresting member being disposed on the backboard of the drawer;

an arresting unit including a linear rail mounted on the inner wall face, the linear rail extending from the top board to the bottom board of the cabinet body, a stop member being disposed at one end of the linear rail near the bottom board, several movable members being slidably arranged on the linear rail respectively corresponding to the drawers, each movable member having a head section directed to the top board and a bottom section directed to the bottom board, the bottom section of the movable member abutting against the head section of an adjacent movable member, the stop member abutting against the bottom section of a bottommost movable member; and a stop mechanism disposed at upper end of the linear rail near the top board for stopping the movable members from sliding upward, a distance between the stop mechanism and the adjacent movable member being within a range from one time to double the thickness of the arresting member of the drawer, the bottom section of each movable member being formed with a working slope, the working slope and the linear rail defining a notch, the head section of each movable member being formed with a slide channel in which a locating member of an adjacent movable member is slidably disposed, the locating member being pivotally mounted on the bottom section of the movable member, the locating member having a first guide face, a second guide face and a recessed hook section between the first and second guide faces, a stop section being disposed on one side of the locating member, one of the first and second guide faces abutting against the slide channel of the adjacent movable member, the stop section of the locating member abutting against the head section of the adjacent movable member to prevent the locating member from dropping out, whereby the arresting member of the drawer can hook the hook section of a corresponding movable member to be located in the notch of the movable member.

The present invention can be best understood through the following description and accompanying drawings wherein:

DETAILED DESCRIPTION OF THE PREFERRED EMBODIMENTS

Figure 1:
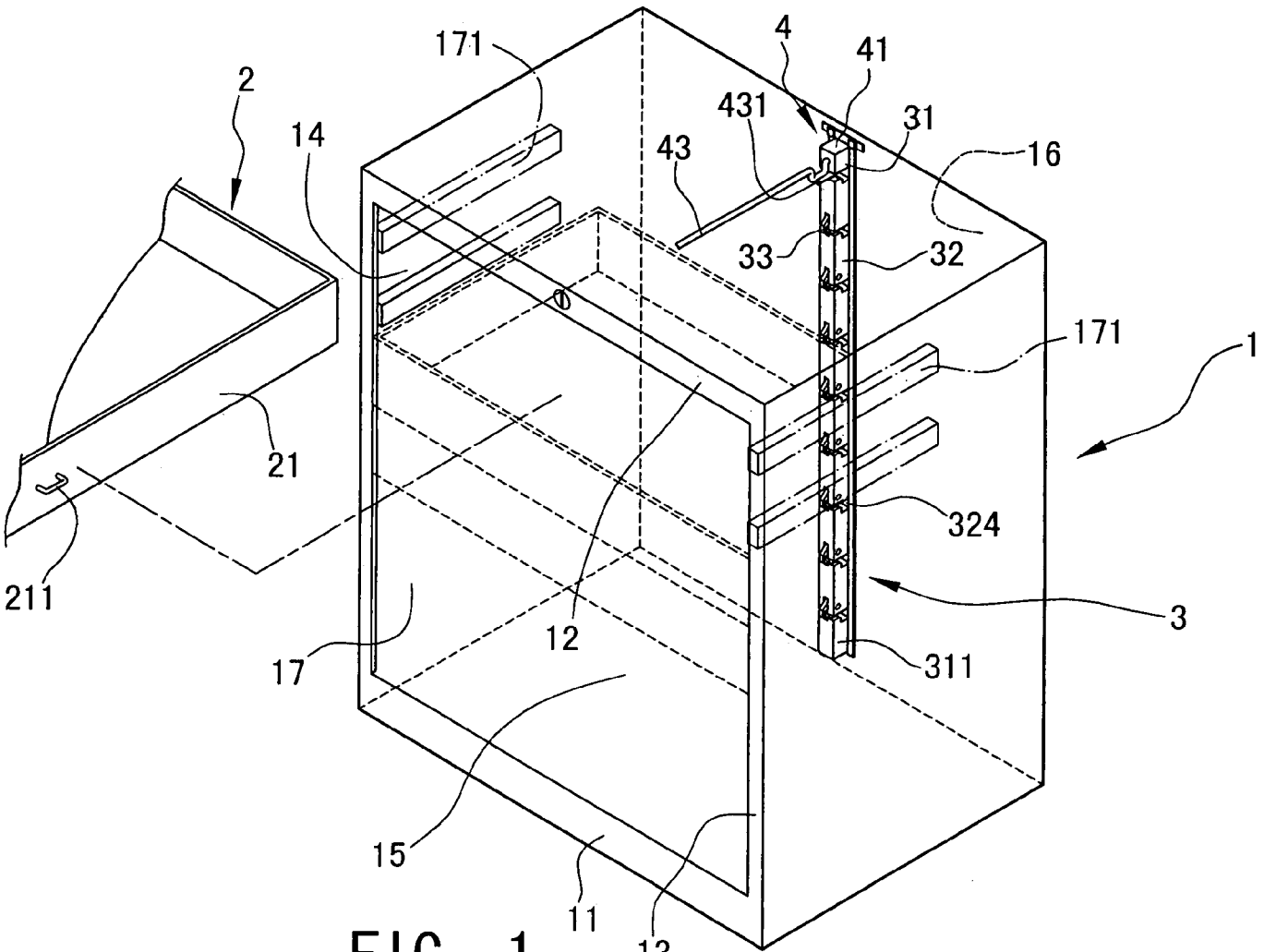
FIG. 1 is a perspective view of the present invention.
Figure 2:
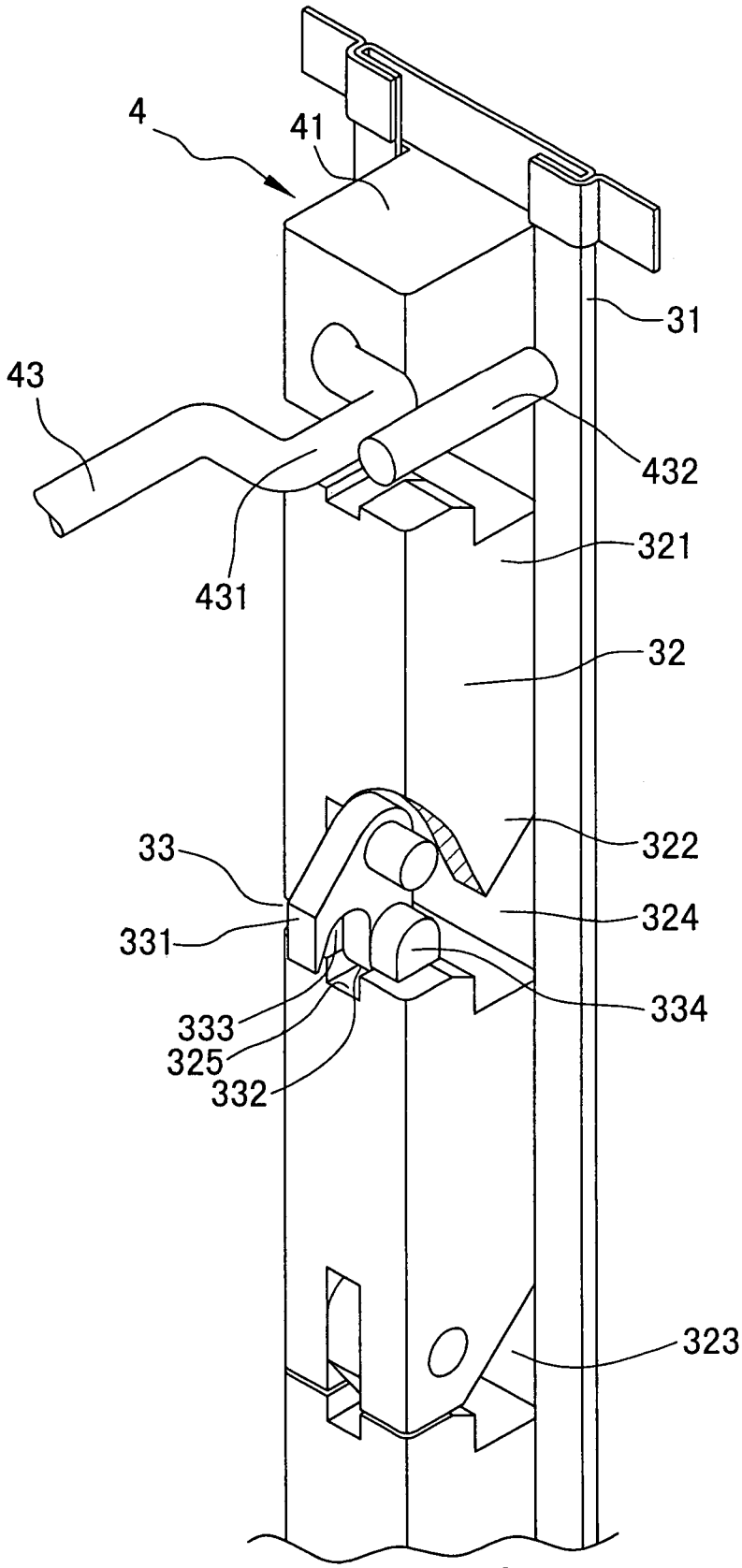
FIG. 2 is a perspective view of the stop mechanism and movable members of the present invention.

Please refer to FIGS. 1 to 4. The arresting apparatus of the multilayer drawers of the present invention includes a cabinet body 1 having a bottom board 11 near the ground and a top board 12 opposite to the bottom board 11. The cabinet body 1 further has several sideboards 13 adjacent to the bottom board 11 and the top board 12. One of the sideboards 13 is formed with an opening 14.

The cabinet body 1 defines therein a receiving space 15 communicating with the opening 14. The cabinet body 1 has an inner wall face 16 opposite to the opening 14. Two opposite sidewalls 17 of the cabinet body 1 are adjacent to the inner wall face 16. Several slide rail assemblies 171 are mounted on each sidewall 17.

A drawer 2 is slidably mounted on each slide rail assembly 171. Each drawer 2 has a back board 21 corresponding to the inner wall face 16. The backboard 21 is positioned in the receiving space 15. An arresting member 211 is disposed on the backboard 21 of the drawer 2. In this embodiment, the arresting member 211 is a locating rod having a rod body parallel to the slide rail assembly 171.

The arresting apparatus further includes an arresting unit 3 including a linear rail 31 mounted on the inner wall face 16. The linear rail 31 extends from the top board 12 to the bottom board 11 of the cabinet body 1. A stop member 311 is disposed at one end of the linear rail 31 near the bottom board 11. In addition, several movable members 32 are slidably arranged on the linear rail 31 respectively corresponding to the drawers 2. Each movable member 32 has a head section 321 directed to the top board 12 and a bottom section 322 directed to the bottom board 11. The bottom section 322 of the movable member 32 abuts against the head section 321 of an adjacent movable member 32. The stop member 311 abuts against the bottom section 322 of a bottommost movable member 32.

The bottom section 322 of the movable member 32 is formed with a working slope 323. The working slope 323 and the linear rail 31 define a notch 324. The head section 321 of each movable member 32 is formed with a slide channel 325 in which a locating member 33 of an adjacent movable member 32 is slidably disposed.

The locating member 33 is pivotally mounted on the bottom section 322 of the movable member 32. The locating member 33 has a first guide face 331, a second guide face 332 and a recessed hook section 333 between the first and second guide faces 331, 332. In addition, a stop section 334 is disposed on one side of the locating member 33. The first guide face 331 abuts against the slide channel 325 of the adjacent movable member 32. The stop section 334 of the locating member 33 abuts against the head section 321 of the adjacent movable member 32 to prevent the locating member 33 from dropping out. The arresting member 211 of the drawer 2 can hook the hook section 333 of a corresponding movable member 32 to be located in the notch 324 of the movable member 32.

When pushing the drawer 2, the drawer 2 will move along the slide rail assembly 171 into the receiving space 15. The arresting member 211 of the drawer 2 is guided by the hook section 333 to enter the notch 324. The arresting member 211 is restricted by the hook section 333 of the locating member 33 and located in the notch 323. The bottom section 322 of the movable member 32 tightly abuts against the head section 321 of an adjacent movable member 32.

Figure 3:
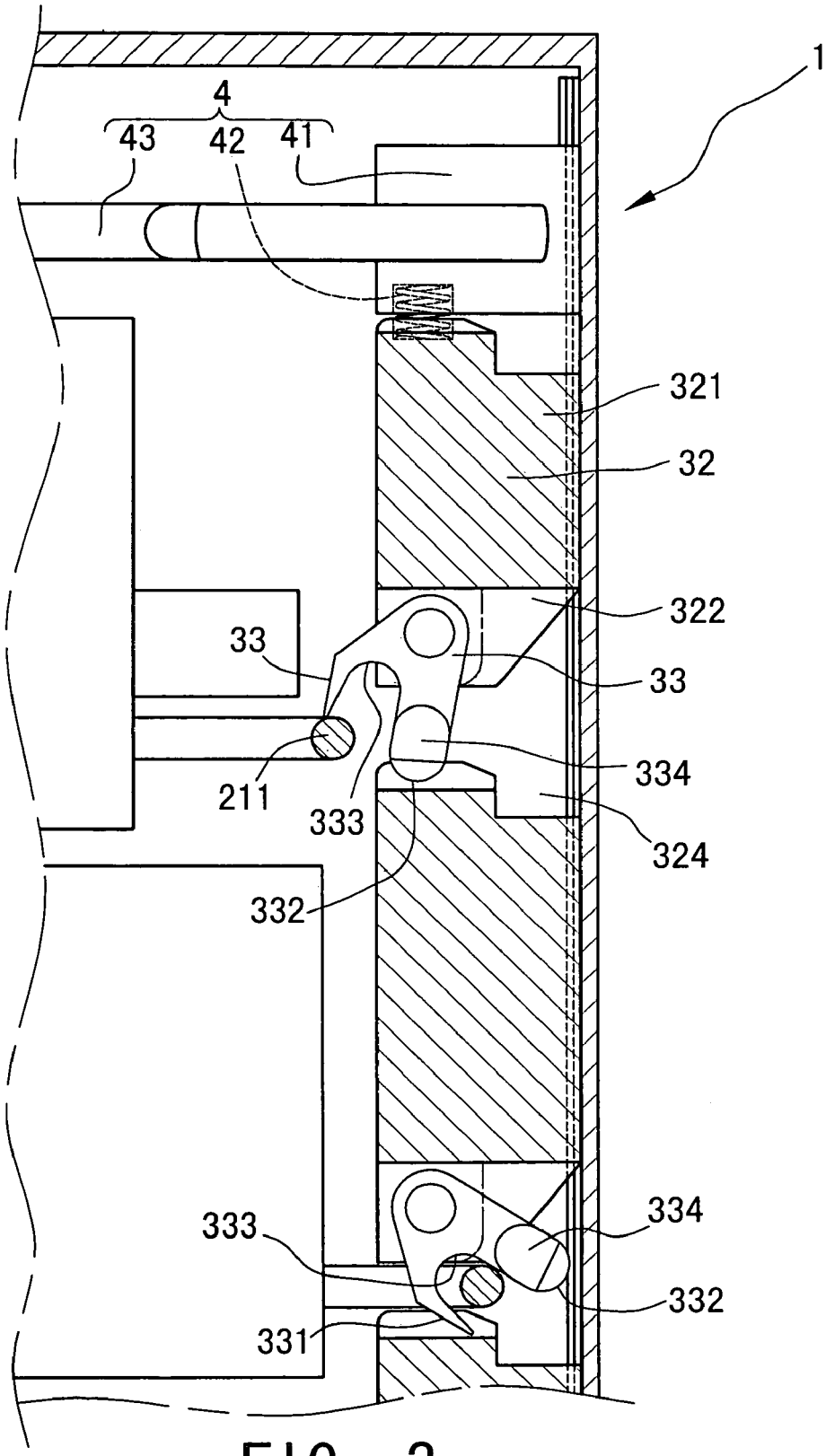
FIG. 3 is a partially sectional view of the movable members of the present invention.

Referring to FIG. 3, a stop mechanism 4 is disposed at upper end of the linear rail 31 near the top board 12 for stopping the movable members 32 from sliding upward. The stop mechanism 4 includes a seat body 41, a push member 42 and an operation rod 43 pivotally connected with the seat body 41. The push member 42 is arranged between the seat body 41 and a movable member 32 adjacent to the seat body 41. In this embodiment, the push member 42 is a spring. The operation rod 43 has a protruding section 431 near the seat body 4. The protruding section 431 is connected with a stop post 432 extending toward the linear rail 31. The stop post 432 can be chucked between the seat body 41 and the head section 321 of the adjacent movable member 32 to prevent the movable member 32 from sliding. In this embodiment, the distance between the stop mechanism 4 and the head section 321 of the adjacent movable member 32 is equal to the thickness of the arresting member 211 of the drawer 2 and also equal to the diameter of the operation rod 43. Further, the distance between the stop mechanism 4 and the head section 321 of the adjacent movable member 32 is also equal to the distance between the bottom section 322 of the movable member 32 and the bottom of the stop section 334 of the locating member 33.

When it is desired to draw out one of the drawers 2, a pulling force is slightly applied to the drawer 2 to detach the arresting member 211 from the hook section 333 of the locating member 33. The stop section 334 of the locating member 33 abuts against the head section 321 of the adjacent movable member 32. At this time, the drawer 2 can be drawn out of the cabinet body 2. The movable members 32 corresponding to the other drawers 2 between the stop mechanism 4 and the drawn out drawer 2 slide upward. Therefore, the arresting members 211 of the drawers 2 are still positioned in the notches 324 between the working slopes 323 of the movable members 32 and the linear rail 31. Under such circumstance, the other drawers will not be extracted out of the receiving space.

In the case that the cabinet body 1 is collided, the arresting members 211 of the respective drawers 2 are still positioned in the notches 324 between the working slopes 323 of the movable members 32 and the linear rail 31. In addition, the movable members 32 are pushed by the push member 42 of the stop mechanism 4. Therefore, the gaps between the adjacent movable members 32 are limited. Accordingly, when the cabinet body 1 is collided and tilted down, the drawers 2 will not drop out of the receiving space 15 of the cabinet body 1.

Figure 4:
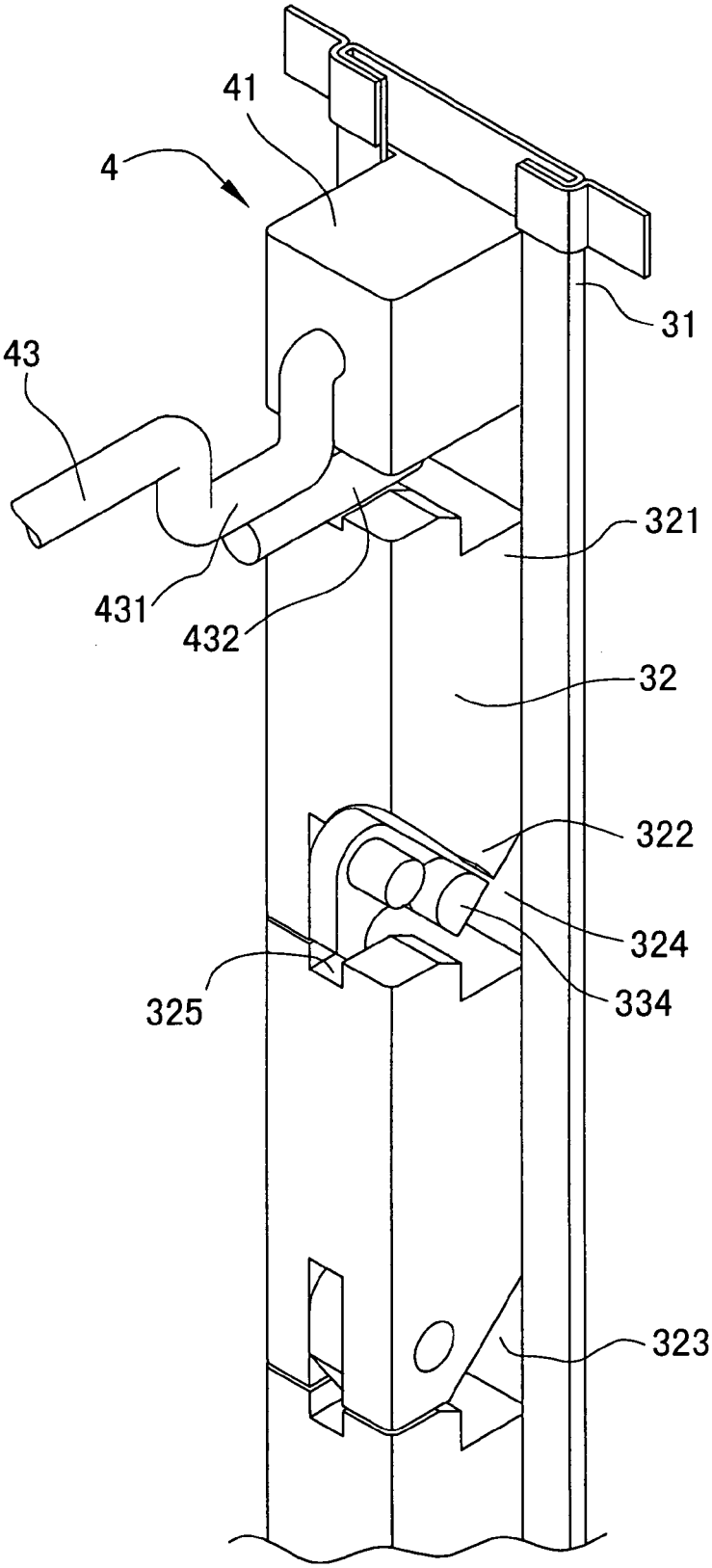
FIG. 4 is a perspective view showing the stop mechanism and movable members of the present invention in a locked state.
Figure 5:
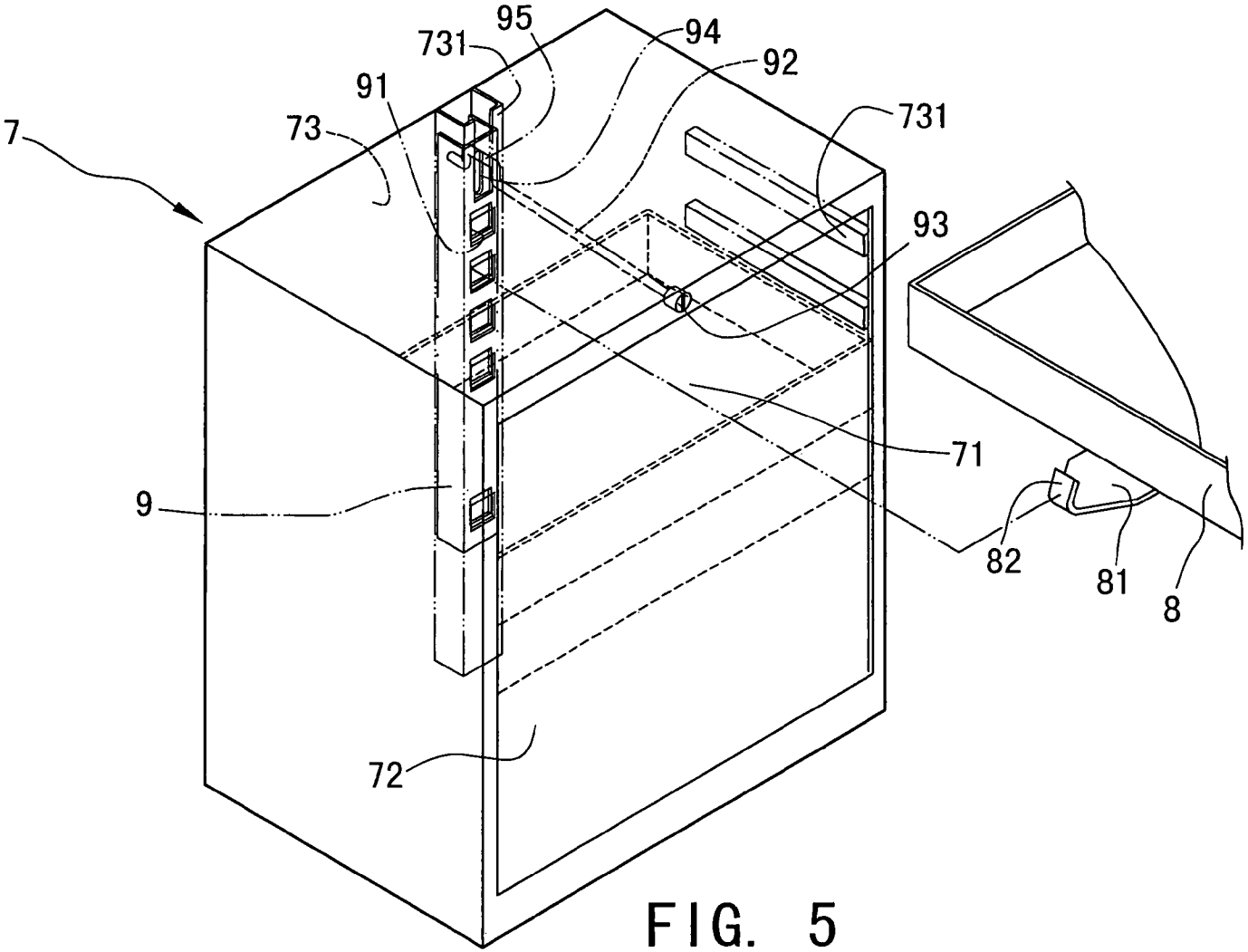
FIG. 5 PRIOR ART
FIG. 5 is a perspective view of a conventional drawer locking structure.

When the drawers 2 are pushed into the receiving space 15 and prevented from being drawn out, the operation rod 43 is turned. At this time, as shown in FIG. 4, the stop post 432 of the stop mechanism 4 is chucked between the seat body 41 and the adjacent movable member 32 to prevent the movable members 32 from sliding. Under such circumstance, the drawers 2 cannot be drawn out of the receiving space 15.

The above embodiments are only used to illustrate the present invention, not intended to limit the scope thereof. Many modifications of the above embodiments can be made without departing from the spirit of the present invention.

What is claimed is:

1. An arresting apparatus of multilayer drawers, comprising:

a cabinet body having a bottom board near the ground and a top board opposite to the bottom board, the cabinet body further having several sideboards adjacent to the bottom board and the top board, one of the sideboards being formed with an opening, the cabinet body defining therein a receiving space communicating with the opening, the cabinet body having an inner wall face opposite to the opening;

several drawers slidably mounted in the receiving space, each drawer having a back board corresponding to the inner wall face, the backboard being positioned in the receiving space, an arresting member being disposed on the backboard of the drawer;

an arresting unit including a linear rail mounted on the inner wall face, the linear rail extending from the top board to the bottom board of the cabinet body, a stop member being disposed at one end of the linear rail near the bottom board, several movable members being slidably arranged on the linear rail respectively corresponding to the drawers, each movable member having a head section directed to the top board and a bottom section directed to the bottom board, the bottom section of the movable member abutting against the head section of an adjacent movable member, the stop member abutting against the bottom section of a bottommost movable member; and a stop mechanism disposed at upper end of the linear rail near the top board for stopping the movable members from sliding upward, the bottom section of each movable member being formed with a working slope, the working slope and the linear rail defining a notch, the head section of each movable member being formed with a slide channel in which a locating member of an adjacent movable member is slidably disposed, the locating member being pivotally mounted on the bottom section of the movable member, the locating member having a first guide face, a second guide face and a recessed hook section between the first and second guide faces, a stop section being disposed on one side of the locating member, one of the first and second guide faces abutting against the slide channel of the adjacent movable member, the stop section of the locating member abutting against the head section of the adjacent movable member to prevent the locating member from dropping out, whereby the arresting member of the drawer can hook the hook section of a corresponding movable member to be located in the notch of the movable member.

2. The arresting apparatus of multilayer drawers as claimed in claim 1, wherein the stop mechanism includes a seat body, a push member and an operation rod pivotally connected with the seat body, the push member being arranged between the seat body and a movable member adjacent to the seat body, the operation rod having a protruding section near the seat body, the protruding section being connected with a stop post extending toward the linear rail, whereby the stop post can be chucked between the seat body and the head section of the adjacent movable member to prevent the movable member from sliding.

3. The arresting apparatus of multi layer drawers as claimed in claim 2, wherein a distance between the stop mechanism and the head section of the adjacent movable member is equal to a thickness of the arresting member of the drawer and also equal to a diameter of the operation rod, further, the distance between the stop mechanism and the head section of the adjacent movable member being also equal to a distance between the bottom section of the movable member and the bottom of the stop section of the locating member.

4. The arresting apparatus of multi layer drawers as claimed in claim 1, wherein the arresting member is a locating rod.

5. The arresting apparatus of multilayer drawers as claimed in claim 1, wherein the push member is a spring.

* * * * *